United States Patent [19]

Hale et al.

[11] 4,197,606

[45] Apr. 15, 1980

[54] METHOD FOR HEAT-SETTING SYNTHETIC YARN

[75] Inventors: Harry F. Hale, Petersburg; Lewis R. Hackler, Hopewell; Raymond J. Biron, Colonial Heights, all of Va.

[73] Assignee: Allied Chemical Corporation, Morris Township, Morris County, N.J.

[21] Appl. No.: 949,710

[22] Filed: Oct. 10, 1978

Related U.S. Application Data

[62] Division of Ser. No. 789,177, Apr. 20, 1977, abandoned.

[51] Int. Cl.[2] ..... D06B 5/20

[52] U.S. Cl. ..... 8/149.2; 8/149.3; 34/15

[58] Field of Search ..... 8/149.3, 155.2, 149 Z; 34/37, 15, 16; 68/5 C; 432/24

[56] References Cited

U.S. PATENT DOCUMENTS 3,699,664 10/1972 Lunsford et al. ..... 34/37 X

FOREIGN PATENT DOCUMENTS 564761 10/1958 Canada ..... 8/149.3

*Primary Examiner*—Philip R. Coe

*Attorney, Agent, or Firm*—Richard A. Anderson

[57] ABSTRACT

The method of this invention comprises the improvement of using an open frame skein carrier with arms to loosely hang the yarn skeins. This allows a shorter total heat-setting time; eliminates kinks, and improves bulk and bulk uniformity of the yarn.

7 Claims, 2 Drawing Figures

METHOD FOR HEAT-SETTING SYNTHETIC YARN

This is a division of application Ser. No. 789,177, filed Apr. 20, 1977, and now abandoned.

BACKGROUND OF THE INVENTION

This invention relates to an improved method to heat-set synthetic yarn by loosely hanging skeins in a conventional autoclave.

The prior art method and apparatus to hold skeins of yarn for heat-setting was to stack the skeins on top of one another in a carrier such as a basket or a series of trays for autoclaving. This method and apparatus produced kinky yarns, failed to develop maximum bulk on the yarn, and produced nonuniform bulk from strand to strand of yarn after heat-setting in an autoclave. See U.S. Pat. No. 3,343,380.

It is also known in U.S. Pat. No. 1,515,556 to loosely hang skeins of rayon for drying.

SUMMARY OF THE INVENTION

The improved method of this invention and the uniquely designed carrier allow the skeins to hang in a relaxed vertical position so that the heat can uniformly reach all portions of all skeins to impart highly desirable properties which are unattainable by other known methods for holding skeins for autoclaving. These desirable and unique yarn properties are:

(1) elimination of yarn kinks,
(2) less loss of bulk from autoclaving and
(3) uniform bulk development from strand to strand within the skein and from skein to skein and from autoclave load to autoclave load.

This method can be applied to either tumbled or nontumbled yarns. Since the treatment of the yarn is more effective with the carrier and method of this invention; the total cycle time for each autoclave load can be reduced, and the actual throughput of pounds of yarn to each autoclave can be increased. In the past, most bulked continuous filament yarn used in twist set cut pile applications has been tumbled prior to autoclaving. In recent years, the market has shown interest in the nontumbled (straight set) carpet yarn. Carpet fabrics developed around this yarn were mostly print base cut piles which have been considered to be most forgiving of yarn defects. In the last two years the fine denier soft hand silky bright look has emerged as a popular fashion in the trade. This fine denier per filament low texture yarn was found to be very sensitive to processing conditions in twist setting, tufting, and dyeing. The major area of sensitivity, i.e., cause of streaks, was found to be the twist setting operation. This invention has overcome the streaks of the prior art method due to yarn kinks, loss of bulk, or nonuniform bulk development.

The apparatus used with the method of this invention is a skein carrier for heat setting synthetic yarns comprising an open frame mounted on an open base, multiple arms spaced to allow skeins to pass between them from a support member mounted on the frame. This allows multiple yarn skeins to hang loosely from the arms for heat setting in an autoclave. The arms can be mounted parallel or perpendicular to the longest dimension of the autoclave vessel. The skein carrier can be mounted on any means to convey the carrier. For example, it could be mounted on a conveyor system or skids.

It is preferably mounted on casters. Also preferably, the arms are cantilevered from the support member.

The method of this invention is for heat setting synthetic yarn loosely hung on skeins on a carrier. The method comprises (a) placing the carrier in a conventional autoclave, then
(b) reducing pressure on the yarn to a vacuum of from about 25 to about 29 inches of mercury, then
(c) introducing steam to the yarn to reach temperature of about 212° F. to about 255° F. for about a period of about 3 to 7 minutes and then exhausting the steam, then
(d) introducing superheated steam to the yarn to reach a temperature of from about 230° F. to about 290° F. for a period of from about 3 to 7 minutes, then exhausting the steam, then
(e) repeating step (d), then again
(f) repeating step (d), for a period of from about 8 to 12 minutes, then
(g) holding the yarn under a vacuum of from about 20 to 28 inches of mercury for a period of from about 6 to 8 minutes, then removing the vacuum.

This method is applicable to nontumbled (straight set) carpet yarn when the skeins are placed on the yarn carrier directly from reeling, or to tumbled carpet yarn when the yarn skeins are placed on the yarn carrier directly after tumbling. The preferable temperature range of steps (d) to (f) is from about 240° F. to about 280° F. This preferred temperature range can be applied to either nontumbled or tumbled yarns. Also, the method can be used when heated air is substituted for steam. It is preferable to use a lower weight traveler during primary and secondary twisting of the yarn prior to forming skeins to lower the yarn tensions to less than conventional tension, preferably less than 0.2 gram per denier.

DESCRIPTION OF THE PREFERRED EMBODIMENT

Figure 1:
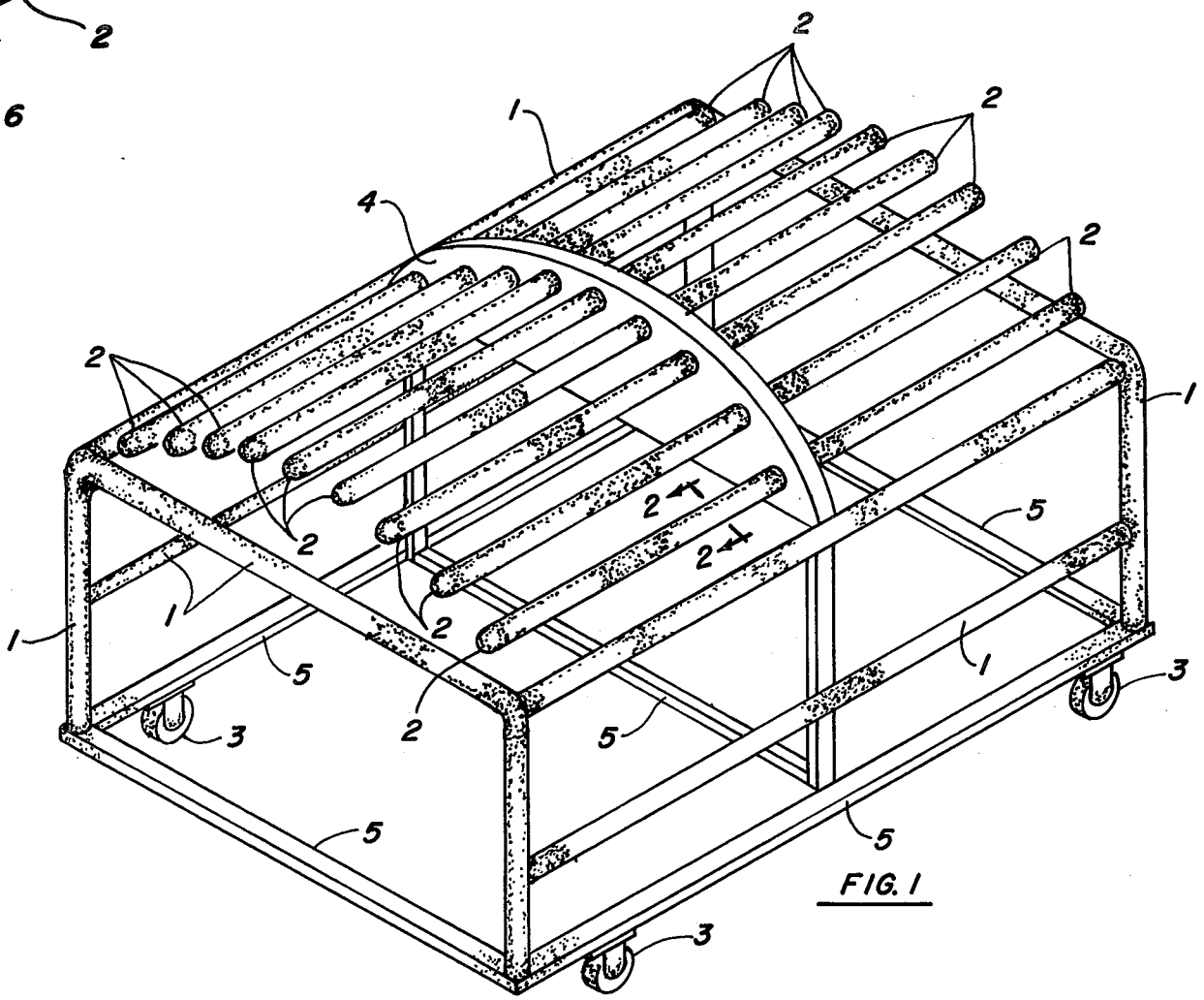
FIG. 1 shows the yarn carrier.

FIG. 1 shows the skein carrier. Open frame 1 is mounted on open base 5 which has support member 4 mounted thereon as shown. Support member 4 has arms 2 cantilevered therefrom as shown. Open base 5 can be mounted on casters 3 as a means of conveyance.

Figure 2:
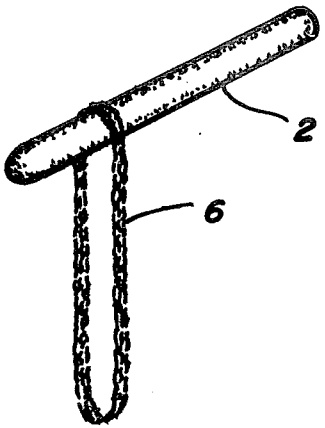
FIG. 2 shows a cross-section of an arm showing a skein hanging in place from the arm.

In FIG. 2, arm 2 is shown with yarn skein 6 hanging in position therefrom.

EXAMPLE

In order to successfully commercialize the low texture, fine denier per filament, soft hand, high luster carpet yarn products, special techniques had to be developed for twist setting. The following describes the differences between the conventional method and the improved method of this invention. The improved apparatus and method of this invention was highly successful for the heat-setting sensitive yarns. Table 1 shows the comparison between the conventional and the improved method of this process for twist-setting. Primary and secondary twisting conditions and reeling conditions are shown along with the autoclave cycle used by the conventional method and the improved method of this invention. Table II is a comparison of the conventional and improved process, including yarn characteristics.

TABLE I

| TWIST SET SPECIFICATIONS COMPARISON | CON-VENTIONAL | THIS INVENTION |
|---|---|---|
| PRIMARY TWISTING | | |
| Spindle Speed, rpm | 5500 | 5100 |
| Starting Yarn Tension, gpd | .277 to .294 | .08 to .10 |
| Ending Tension, gpd | .231 to .254 | .10 to .12 |
| Bobbin Net Weight, Lbs. | 5.52 | 5.25 |
| SECONDARY TWISTING | | |
| Spindle Speed, rpm | 5100 | 5100 |
| Starting Yarn Tension, gpd | .288 to .296 | .10 to .15 |
| Ending Yarn Tension, gpd | .200 to .215 | .09 to .12 |
| Bobbin Net Weight, Lbs. | 6.41 (Skein Size) | 5.25 (Skein Size) |
| REELING | | |
| Yarn Skein Traverse, Inches | 5.5 | 5.5 |
| Reel, rpm | 390 | 400 |
| Number of Leases Per Skein | 6 | 6 |
| AUTOCLAVE CYCLE | | |
| Number of Skeins Per Basket | 72 (Laid in Basket) | 68 (Hung on Pins) |
| 1. Prevacuum to 27 Inches | 4.5 Minutes | 4.5 Minutes |
| 2. 1st Condition - Steam and Hold (235° F.) | 10.0 Minutes | 5.0 Minutes |
| 3. Exhaust | 0.6 Minute | 0.6 Minute |
| 4. 1st Process - Steam and Hold (270° F.) | 5.0 Minutes | 5.0 Minutes |
| 5. Exhaust | 1.6 Minutes | 1.6 Minutes |
| 6. 2nd Process - Steam and Hold (270° F.) | 5.0 Minutes | 5.0 Minutes |
| 7. Exhaust | 1.6 Minutes | 1.6 Minutes |
| 8. 3rd Process - Steam and Hold (270° F.) | 5.0 Minutes | 10.0 Minutes |
| 9. Exhaust | 1.6 Minutes | 1.6 Minutes |
| 10. 4th Process - Steam and Hold (270° F.) | 5.0 Minutes | — |
| 11. Exhaust | 1.6 Minutes | — |
| 12. Postvacuum (23–27 Inches) | 5.0 Minutes | 8.0 (Hold); Minutes |
| 13. Vacuum Release | — | — |

We claim:

1. A method for heat setting synthetic yarn loosely hung in skeins on a carrier comprising
   (a) placing said carrier in a conventional autoclave, then
   (b) reducing pressure on said yarn to a vacuum of from about 25 to about 29 inches of mercury, then
   (c) introducing steam to said yarn to reach a temperature from about 212° F. to about 255° F. for a period of from about 3 to 7 minutes, then exhausting said steam, then
   (d) introducing superheated steam to said yarn to reach a temperature of from about 230° F. to about 290° F. for a period of from about 3 to 7 minutes, then exhausting said steam, then
   (e) repeating step (d), then again
   (f) repeating step (d) for a period of from about 8 to 12 minutes, then
   (g) holding said yarn under a vacuum of from about 22 to 28 inches of mercury for a period of from about 6 to 8 minutes, and removing said vacuum.

2. The method of claim 1 wherein said yarn skeins are placed on said yarn carrier directly from reeling.

3. The method of claim 1 wherein said yarn skeins are placed on said yarn carrier directly after tumbling.

4. The method of claim 1 wherein steps (d) to (f) are carried out at a temperature of from about 240° F. to about 280° F.

5. The method of claim 4 wherein said yarn skeins are placed on said yarn carrier directly from reeling.

6. The method of claim 4 wherein said yarn skeins are placed on said yarn carrier directly after tumbling.

7. A method for heat setting synthetic yarn loosely hung in skeins on a carrier comprising
   (a) placing said carrier in a conventional autoclave, then
   (b) reducing pressure on said yarn to a vacuum of from about 25 to about 29 inches of mercury, then

TABLE II

COMPARISON OF CONVENTIONAL AND IMPROVED PROCESS INCLUDING YARN CHARACTERISTICS

| PRIMARY TWISTING | CONVENTIONAL PROCESS | PROCESS OF THIS INVENTION | COMMENTS |
|---|---|---|---|
| Startup Tension, Grams/Denier | >.2 | <.2 | Lower weight traveler reduced tension. |
| SECONDARY TWISTING | | | |
| Startup Tension, Grams/Denier | >.2 | <.2 | Lower weight traveler reduced tension. |
| REELING | | | |
| Skein Leases | Slightly tight | Loose | Loose leases minimize yarn defects (fish hooks), no restriction on even bulk development. |
| AUTOCLAVE | Skeins laid in basket | Skeins hung on special carrier | Stack/laid skeins cause thick and thin strands and low bulk development which result in optical streaks. Hung skeins allow uniform bulk development and thus low or no optical streaks. |

SPECIAL TRIAL

A trial was run to compare skeins hung on the carrier of this invention to skeins laid (stacked) in baskets to determine yarn differences. All others were at what was considered to be optimum for these fine DPF products. These trial yarns were tufted on a 3/16-inch GA tufting machine to make cut pile carpet in bands for direct comparison. Results of this trial are as follows:

| PROPERTIES | CONVENTIONAL-LAID/STACKED SKEINS | PROCESS OF THIS INVENTION, HUNG SKEINS | COMMENTS |
|---|---|---|---|
| Bulk | Uneven | Advantage - 1–1.5 Oz. at 32 Oz./Yd.$^2$ | More money value with hung skeins. |
| Tips | Flared and Flat | Round, uniform | Better tip appearance with hung skeins. |
| Uniformity | Yarn Streaks | Very uniform | Much superior and acceptable uniformity with hung skein and poorer and unacceptable with laid/stacked skeins. |

(c) introducing heated air to said yarn to reach a temperature from about 212° F. to about 255° C. for a period of from about 3 to 7 minutes, then exhausting said air, then (d) introducing heated air to said yarn to reach a temperature of from about 230° F. to about 290° F. for a period of from about 3 to 7 minutes, then exhausting said air, then (e) repeating step (d), then again (f) repeating step (d) for a period of from about 8 to 12 minutes, then (g) holding said yarn under a vacuum of from about 22 to 23 inches of mercury for a period of from about 6 to 8 minutes, and removing said vacuum.

* * * * *

UNITED STATES PATENT AND TRADEMARK OFFICE

CERTIFICATE OF CORRECTION

PATENT NO. : 4,197,606

DATED : April 15, 1980

INVENTOR(S) : Harry F. Hale, Lewis R. Hackler & Raymond J. Biron

It is certified that error appears in the above-identified patent and that said Letters Patent are hereby corrected as shown below:

Column 5, line 2, "255°C." should read --255°F.--

Signed and Sealed this

*Twenty-second* Day of *July 1980*

[SEAL]

*Attest:*

SIDNEY A. DIAMOND

*Attesting Officer*

*Commissioner of Patents and Trademarks*